US006079196A

United States Patent [19]

Linder et al.

[11] Patent Number: 6,079,196

[45] Date of Patent: Jun. 27, 2000

[54] BAND OF ARTICULATED LINKS AND WATCH PROVIDED WITH SUCH A BAND

[75] Inventors: Stéphane Linder, Neuchâtel, Switzerland; Silvano Carraro, Camposampiero, Italy

[73] Assignee: Tag Heuer SA, Marin-Epagnier, Switzerland

[21] Appl. No.: 09/242,479

[22] PCT Filed: Aug. 29, 1996

[86] PCT No.: PCT/CH96/00297

§ 371 Date: Feb. 18, 1999

§ 102(e) Date: Feb. 18, 1999

[87] PCT Pub. No.: WO98/08408

PCT Pub. Date: Mar. 5, 1998

[51] Int. Cl.[7] ..... F16G 13/08

[52] U.S. Cl. ..... 59/80; 63/4

[58] Field of Search ..... 59/78, 80, 82; 63/4

[56] References Cited

U.S. PATENT DOCUMENTS

| | | | |
|---|---|---|---|
| 1,995,517 | 2/2000 | Neugass | 59/82 |
| 2,392,116 | 1/1946 | Blumstein | 59/80 |
| 3,690,064 | 9/1972 | Pompeo | 59/35 |
| 4,089,161 | 5/1978 | Aoki | 59/80 |
| 6,026,637 | 2/2000 | Dombre et al. | 59/80 |

FOREIGN PATENT DOCUMENTS

| | | |
|---|---|---|
| 0 006 664 | 1/1980 | European Pat. Off. . |
| 0 125 578 | 11/1984 | European Pat. Off. . |
| 0 321 036 | 6/1989 | European Pat. Off. . |
| 482 421 | 1/1970 | Switzerland . |
| 653 871 | 1/1986 | Switzerland . |
| 661 184 | 7/1987 | Switzerland . |
| 669 316 | 3/1989 | Switzerland . |

*Primary Examiner*—David Jones
*Attorney, Agent, or Firm*—Oliff & Berridge, PLC

[57] ABSTRACT

The watchband includes, for example, three rows of metallic links. The links of the first central row (1, 1', etc.) are shifted with respect to the links of the two other rows (2, 2', etc.). Each link of the central row (1') can pivot with respect to the preceding link (1) and with respect to the following link (1") about pins (3) connected to the links of lateral rows. Stop elements, for example other pins (4, 4') likewise connected to the links of lateral rows, allow limitation of the pivot angle of the central links about the first pins (3). The links can be removed to adjust the length of the band. Advantages: ergonomics, avoidance of the risk of pinching skin or hair, aesthetics, reduction of the wear and tear of the surface of the links, control of the curvature of the band and of the interstices between successive links.

13 Claims, 3 Drawing Sheets

Figure 1:
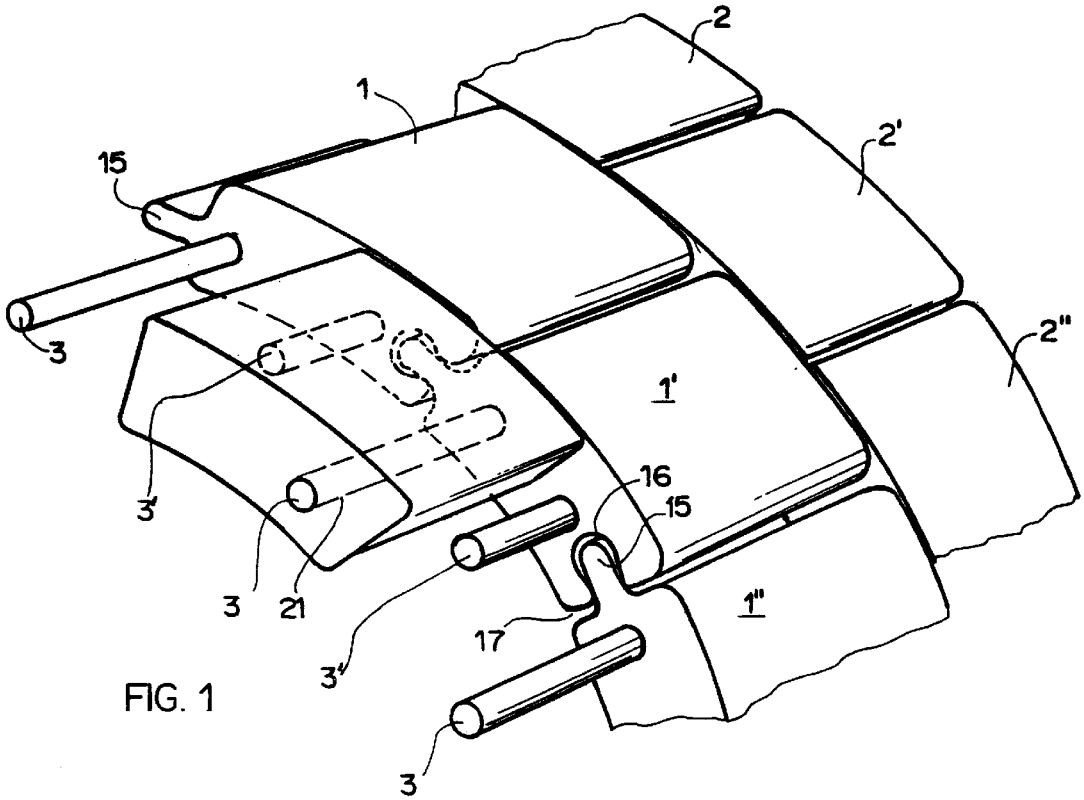

FIG. 4
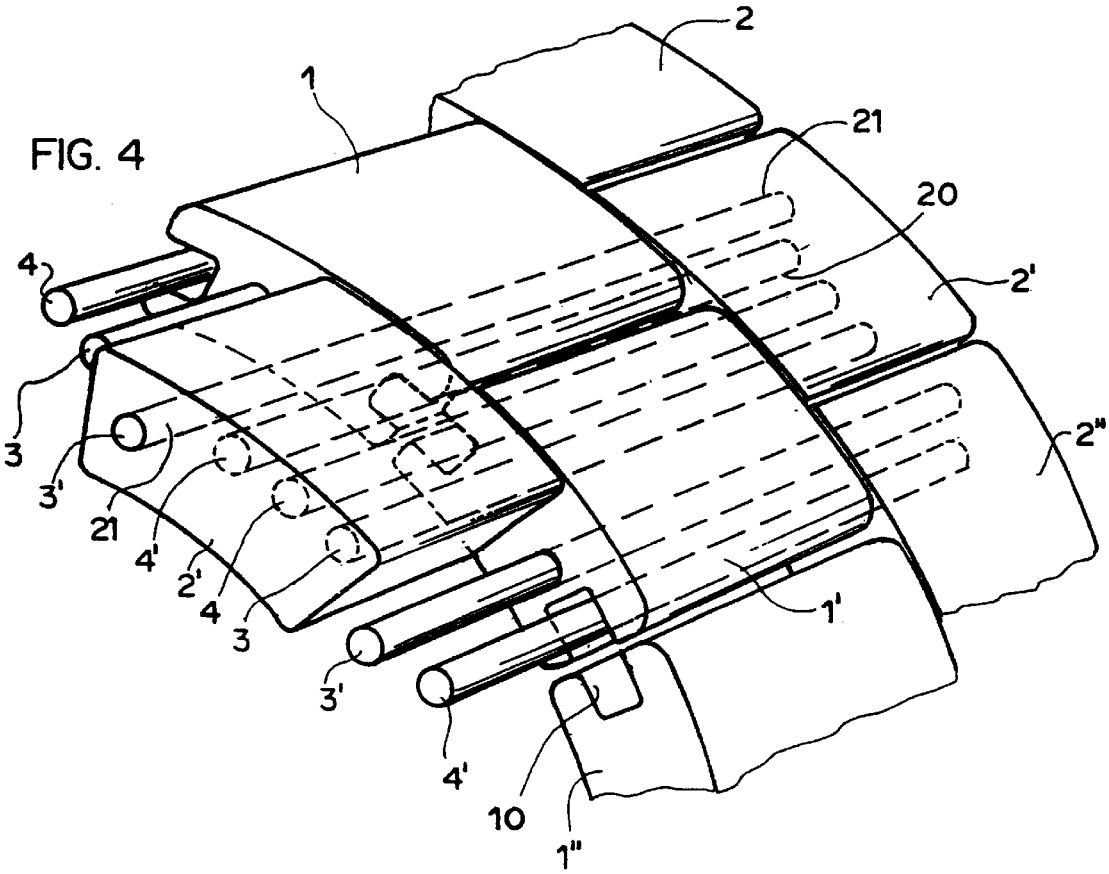
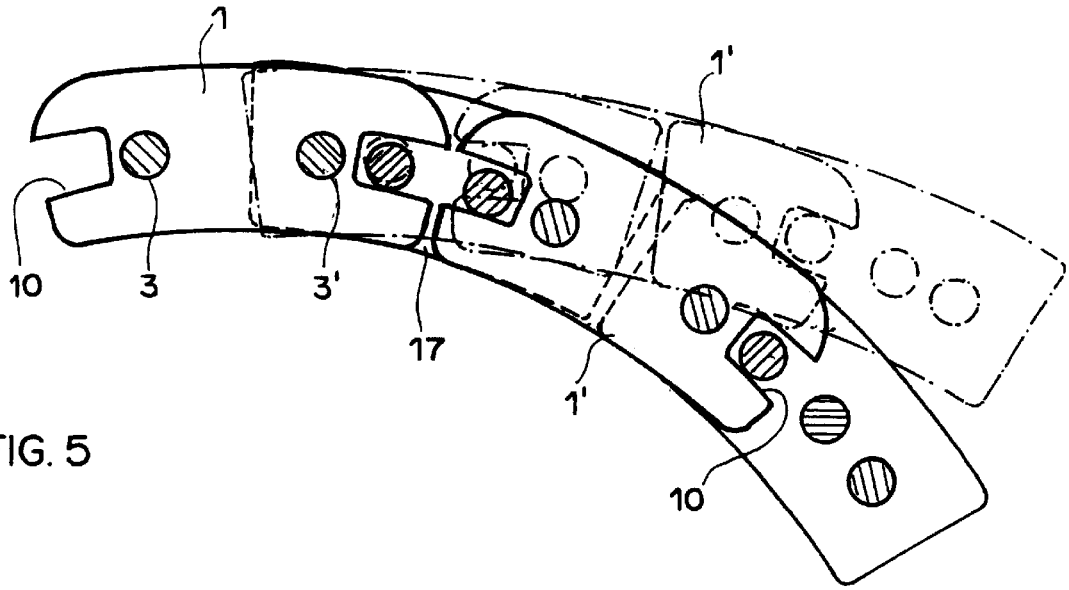
FIG. 5

BAND OF ARTICULATED LINKS AND WATCH PROVIDED WITH SUCH A BAND

This invention relates to a band or bracelet, in particular a watchband. More precisely, this invention relates to a watchband having articulated links. This invention likewise concerns a watch equipped with such a band.

Among the different types of watchbands known, the bands made up of several rows of articulated metallic links are particularly sturdy and their aesthetic quality is well suited to sport watches, for example.

One object of the invention is to improve the ergonomics and the comfort of this type of band.

One aspect of the invention is that the band includes stop elements limiting the pivot angle of the links. Thus any pinching of skin or hair between the links is avoided even when the angle of curvature of the band has to be very small.

Although the patent CH-A5-661 184 describes a band including stop elements to limit the pivot angle of the links, the solution described is limited to bands provided with a single row of links. Moreover, this band is complicated to manufacture.

The band described in the patent CH 482 421 likewise has only a single row of links. The opening of the band is limited by the stops, which are made up of lines of contact on the upper face of the band.

The patent CH-C-669316 describes a bracelet with three rows of links in which the angle of pivoting of the articulated links is only limited by portions of the upper, respectively lower, faces of the links.

A further advantageous aspect of the invention is that the stop elements prevent any direct contact between links. Avoided in this way is. the wear and tear caused by friction on the lines or surfaces of contact between inks. This feature is particularly advantageous for bands covered with a precious metal plating, which tends to be damaged if the links enter into direct contact.

According to a further advantageous aspect of the invention, the successive links of at least one row are separated by interstices. These interstices remain, regardless of the curvature given to the band. The width of these interstices can be perfectly controlled by means of the stop elements. These interstices suffice to avoid any pinching of the skin or hair and to improve the aeration of the skin and the evacuation of perspiration between the links. This feature, moreover, makes it possible to produce more aesthetic bands. In a preferred variant, the successive links on the inside of each row are separated by interstices.

According to a further advantageous aspect of the invention, the curvature of the band can be perfectly controlled by means of stop elements. It is thus possible to obtain, for example, a regular curvature between successive links, and thus an especially aesthetic band.

The stop elements are visible preferably only very slightly, or not at all, from the exterior of the band, and stop against a portion of links distinct from the main faces, for example, against the inside of an aperture through the links. In this way the contact and the wear and tear between links takes place solely at those places which are barely visible or not visible at all.

According to another advantageous aspect of the invention, at least certain links can be easily removed or added in order to adjust the length of the band with respect to the wrist of the wearer. The links can be removed preferably without removing the corresponding stop element.

According to a further advantageous aspect of the invention, the band is of simple and inexpensive construction, having a limited number of separate parts and allowing easy assembly.

Figure 2:
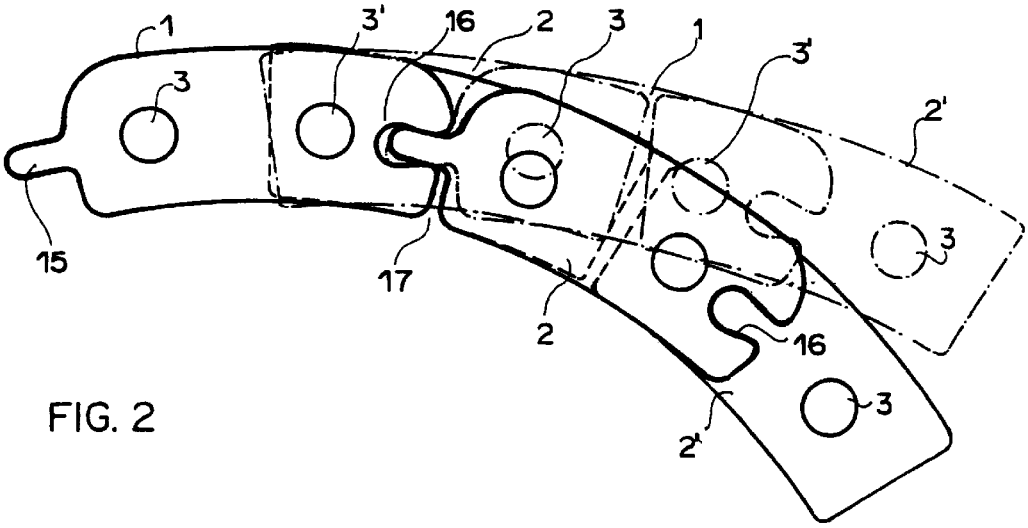
Figure 3:
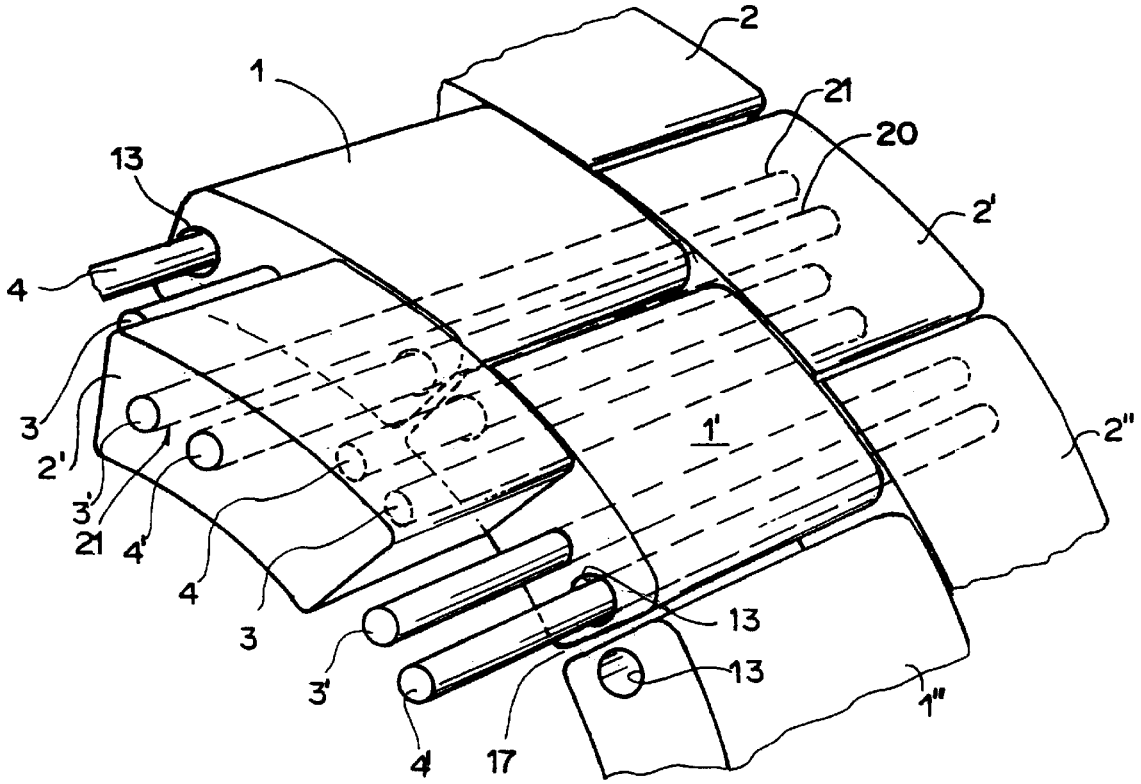

Other advantages and details of the invention will be better understood from reading the examples described in more detail in the following, and from the corresponding figures which illustrate:

FIG. 1, a view in perspective of a first variant of the band having stop elements in the form of tongues connected to the links of the first row, FIG. 2, a lateral view of the band according to the first variant, illustrating, superimposed, two extreme positions of the links of the first row, FIG. 3, a view in perspective of a second variant of the band having stop elements in the form of pins connected to the links of the second row and stopping against the inside of a larger aperture provided through the links of the first row, FIG. 4, a view in perspective of a preferred third variant of the band having stop elements in the form of pins connected to the links of the second row and stopping against the inside of a recess in the forward face of the links of the first row, FIG. 5, a side view of the band according to the third variant illustrating, superimposed, two extreme positions of the links of the first row.

The band segment shown in FIG. 1, by way of example, has three rows of metallic links. The central row ("first row") is made up of successive links 1, 1', etc. Each of the other two lateral rows is constituted by symmetrical links 2, 2', 2", etc. In this example, all the links are of approximately the same length and the same thickness. The links of the central row, however, are shifted by about one half length of a link with respect to the links of the other two rows. The links could, however, have variable lengths and thicknesses, and the shifting between rows could be different.

In the example shown, the links have an approximately flat or convex upper face. The lower face, close to the skin, is approximately parallel to the upper face. The two side faces are approximately flat and parallel. The forward face is only roughly flat and is provided with a recess 16. In the same way, the rearward face is provided with a stop element 15. Different and extremely varied possible shapes of links can, of course, be dictated by aesthetic considerations. The different faces of the links, in particular the upper face, might be shapely rather than flat. The different links could also have a very rounded pea-shaped form, for example.

Each link of the first row, for example the link 1', can pivot with respect to the preceding link 1, about a first pin or pivot 3. The pin 3 is fitted in apertures 21 provided in two adjacent links 2 of the second row. If the links 1' or 2' have to be removable, in order to adjust the length of the band, the aperture 21 passes through the links 2' in such a way that the pin 3 can be withdrawn and the links removed. If, on the contrary, the links 1<sic. 1'>and 2' do not need to be removable, apertures 21 are preferably selected, which do not pass completely through the links 2' and thus allow the two ends of the pins 3 to be concealed.

In the same way, each link 1' of the central row can pivot with respect to the following link 1" about a second pin 3' fitted in apertures 21 provided in two adjacent links 2" of the second row. It is not necessary that the second pin 3' be removable: the links can be withdrawn by groups of three by removing only the first pin 3.

If no stop element has been provided, the pivoting of links 1', 2' about the pin 3 will be limited only by direct contact with another link 1 or 2. In the case of pivoting counterclockwise (increase of the local radius of curvature of the band), contact would be made close to the upper convex face of the link 1' or 2', which could damage, in the long run, the finish of the surface of the link. On the other hand, in the case of clockwise pivoting (decrease of the local radius of curvature of the band), contact would be made close to the lower face of the link 1' or 2', which risks pinching the skin or the hair of the wearer.

In the first variant of the invention, each link of the first row 1, 1', etc. is provided with a stop element in the form of tongue 15 which will be inserted in the corresponding recess 16 of the previously pivoting link. It is of course also possible to reverse the placement of tongue 15 and recess 16. The shape of tongues 15 is foreseen in such a way that the links fit together without difficulty. These stop elements 15 allow limitation of the pivot angle of the links 1' of the first row about the pins 3 and 3'.

FIG. 2 facilitates better understanding of the action of the stop elements 15. It shows, superimposed, two extreme positions taken by the links of the first row. It is seen that in the upper position shown, when the radius of curvature of the band at this place is maximal, the contact between the link 1 and the following link 1' is made essentially between the lower part of the stop element 15 and the lower part of the corresponding recess 16. Similarly, in the lower position shown, when the radius of curvature of the band at this place is minimal, the contact between the link 1 and the following link 1' is made essentially between the upper part of the stop element 15 and the upper part of the corresponding recess 16. The main faces of the two successive links never enter into contact, and an interstice 17 always remains between the lower faces of the links. The only contact surface between the two successive links 1, 1' is confined to an area far from the faces, in the recess 16, where the risk of pinching is minimal and the wear and tear is less detrimental to the aesthetic quality of the band.

One skilled in the art will understand that the stop elements 15 likewise limit the pivot angle of the links of the other lateral rows 2, 2', etc.

Diverse shapes are conceivable for tongues 15 and corresponding recesses 16. Recess 16 could be less closed than in FIGS. 1 and 2 in order to confine the surface of contact to an area even farther away from the main faces.

FIG. 3 shows a view in perspective of a second variant of the band according to the invention. The elements which are the same or similar to those of the first variant, described above, bear the same numbering and they do not have to be described again here.

In this second variant, the stop elements limiting the pivot angle of the pivoting links 1, 1', shows are made up of pins 4, 4' connected to links of other lateral rows 2, 2', etc. These pins traverse holes 13 through the pins 1, 1', shows of the first row. The diameter of holes 13 is greater than the diameter of the active portion of the corresponding pins 4, 4'. The central links 1, 1', shows can pivot about pins 3 and 3', the pivot angle being limited however by the limited clearance of the pins 4, 4' in the apertures 13.

It is of course possible to reverse this placement and to use stop pins connected to the central links 1, 1' etc., and cooperating with larger holes in the lateral links 2, 2', etc.

Compared to the first variant of the invention, described above in relation to FIGS. 1 and 2, this second variant has the advantage of a much easier machining of the links. The pivot angle of the links 1, 1', shows can be easily controlled by adapting the diameter and/or placement of the apertures 13 and/or pins 4, 4'. This solution allows, for example, the maximal pivot angles to be varied along the band: certain links can be fitted together almost rigidly with the apertures of small diameter 13, whereas other links can be fitted together more slackly with the apertures of large diameter 13, giving a bigger clearance to pins 4, 4'. Moreover, it is possible to vary, after cutting, the maximal or minimal radius of curvature of the band by replacing links with others provided with apertures 13 of different diameter, or by using pins 4, 4' of different diameter, or by using links provided with differently placed apertures 20, 13. The curvature and the shape of the band can thus be adapted to the wrist of the wearer without changing the number of links.

The different links can only be made removable if the articulation pins 3' as well as the stop pins 4' can be withdrawn. When these two pins are withdrawn, the assembly between the links 2', 1' and 2' and the respective preceding links 2, 1, 2 becomes loose. The pins 3 and 4 have to be withdrawn only if it is necessary to remove the links 2', 1', 2' individually, which is not generally necessary. It is thus necessary to provide at least two through holes 20, 21 through the lateral links 2, 2', etc., which is not very aesthetic and which complicates the assembly and disassembly of the band.

FIG. 4 shows a view in perspective of a third advantageous variant of the band with respect to the above point. The elements which are the same or similar to those of the variants described above bear the same numbering, and it is not necessary to describe them again here.

In this third variant, as in the second variant, the stop elements limiting the pivot angle of the links 1, 1', shows are made up of pins 4, 4' connected to As the links of the other rows 2, 2', etc. However, these pins pass here through recesses 10 machined in the forward face in front of links 1, 1', etc. The height of recesses 10 is larger than the diameter of the diameter of the active portion of corresponding pins 4. 4' in the recess. The recesses 10 can have, for example, a rectangular profile and can be easily made, for example, by milling. The links 1, 1', shows of the first row can pivot about pins 3 and 3', the pivot angle being limited, however, by the limited clearance of the pins 4, 4' in the recesses 10.

FIG. 5 facilitates better understanding of the action of the stop elements 4, 4' in the recesses 10. It shows, superimposed, two extreme positions adopted by the links of the first row. It can be seen that, in the upper position shown, when the local radius of the curvature of the band is maximal, the articulation between the link 1 and the following link 1' is limited solely by the contact between the lower part of the pin 4' and the lower part of the corresponding recess 10. Similarly, in the lower position shown, when the local radius of curvature of the band is minimal, the articulation between the link 1 and the following link 1' is limited solely by the contact between the upper part of the pin 4' and the upper part of the corresponding recess 10. The different faces of the different links never enter into contact. The only stop zone limiting the articulation of the links is confined to the bottom of the recess 10, where the risk of pinching is less and the wear and tear is the least detrimental to the aesthetic quality of the band.

Compared to the second variant, this solution allows links to be withdrawn or added without removing the pins 4, 4'.

One skilled in the art will understand that the invention easily applies to bands having any number of rows N greater or equal to two, and that the number of three rows selected above is only by way of preferred example. Moreover, one skilled in the art will know how to adapt the invention, without any difficulty, by placing the stop elements 4, 4' or 15 on a row of links other than the central row, or possibly on a plurality of rows of links. For example, instead of providing stops acting upon the links 1, 1', shows of the central row, stops acting upon the links of another row could be preferred, for example, on the lateral links 2, 2', etc.

In all the above examples, the pivoting of the links is limited in both directions, as well as in the case of increase or reduction of the radius of curvature of the band. By adapting slightly the shape or the placement of the stop elements 4, 4' or 15 or of the corresponding apertures 10, 13, 16 it is possible, however, to limit the pivoting of the links in one direction only. For example, if the band has to be able to be laid flat, the possibility of increasing the radius of curvature of the band will possibly be dispensed with. In the same way, by playing with the placement of the stop elements and the corresponding apertures, it is possible to eliminate the possibility of limiting the reduction of the radius of the curvature of the band.

In the variants shown in FIGS. 3 to 5, two distinct stop elements 4 and 4' are provided to limit the pivoting of a link with respect to the preceding link and with respect to the following link of the same row. Depending upon the shape and the spacing of the links, a single stop 4 or 4', limiting the pivoting with respect to the preceding link only or with respect to the following link only, can prove sufficient.

In these variants, the stop pins 4, 4' pass completely through the central links. It is nevertheless possible to use stops connected to peripheral links 2, 2', etc., which would not pass completely through the holes 13 or the recesses 10 through the central links 1, 1', etc. For example, it is possible to replace each pin 4, 4' with two pin portions. In that case the first pin portion is connected to a lateral link 2, 2', etc., and the second pin portion is connected to the corresponding link of the other lateral row. The holes or recesses 10, 13, then do not have to be through holes or through recesses.

It is clear that the links of the band do not necessarily have to be of the shape shown in the figures. In particular, the links close to the horns of the watch or clasp may have to be specially adapted. Moreover it is possible to provide stop elements only on certain links of the band, even on a single link. It is to be understood that it is also possible to produce bands having several types of links according to the examples described above.

What is claimed is:

1. A band comprising:

a first row including articulated links that are aligned with respect to each other;

at least one further row of links that are aliened with respect to each other, said at least one farther row being adjacent to said first row, said at least one further row including first pine connected to the links of said at least one further row of links;

said articulated links being pivotable about a pivot angle with respect to adjacent articulated links of the first row about the first pins of said at least one further row; and stop elements limiting the pivot angle of the articulated links about the first pins.

2. The band according to claim 1, wherein said articulated links further pivot with respect to adjacent links of the first row about second pins connected to further links of said at least one further row; and stop elements limiting a pivot angle of the articulated links about the second pins.

3. The band according to claim 1, the band including three rows of links, each of the rows of links having a center, the distance between the centers of two consecutive links of the same row being approximately constant, said first row being shifted with respect to the links of said other rows.

4. The band according to claim 1, wherein the stop elements co-operate with consecutive links of the first row of articulated links whose pivoting must be limited.

5. The band according to claim 1, wherein the stop elements co-operate with the links of said at least one further row.

6. The band according to claim 5, wherein the stop elements are pins connected to links of said at least one further row and shifted with respect to the first and second pins.

7. The band according to claim 5, wherein consecutive links of each row are separated by interstices between the links, the interstices being present regardless of the curvature of the band.

8. The band according to claim 1, wherein each of the articulated links includes at least one of an approximately flat external face and an approximately convex external face, the stop elements stop against an active portion of an adjacent link, said active portion of each link being distinct from said approximately flat or convex external faces.

9. The band according to claim 8, wherein the stop elements in respective articulated links stop against the inside of corresponding apertures provided in adjacent respective articulated links, said apertures being larger than the active portion of the corresponding stop elements.

10. The band according to claim 9, wherein each of said apertures is a hole through the articulated links.

11. The band according to claim 9, wherein said apertures extend through the articulated links and define recesses in a frontal face of respective articulated links, the recesses allowing the articulated links to be withdrawn without disassembly of a corresponding stop element.

12. The band according to claim 1, further including a plurality of articulated links and a plurality of corresponding stop elements, said stop elements define different pivot angles for the different articulated links.

13. A watch including the band according to claim 1.

* * * * *